US007045764B2

(12) United States Patent
Beggs et al.

(10) Patent No.: US 7,045,764 B2
(45) Date of Patent: May 16, 2006

(54) PASSIVE DETECTION SYSTEM FOR DETECTING A BODY NEAR A DOOR

(75) Inventors: Ryan P. Beggs, Dubuque, IA (US); Lucas I. Paruch, Dubuque, IA (US); James C. Boerger, Franksville, WI (US)

(73) Assignee: Rite-HIte Holding Corporation, Milwaukee, WI (US)

( * ) Notice: Subject to any disclaimer, the term of this patent is extended or adjusted under 35 U.S.C. 154(b) by 0 days.

(21) Appl. No.: 10/272,748

(22) Filed: Oct. 17, 2002

(65) Prior Publication Data

US 2004/0075046 A1 Apr. 22, 2004

(51) Int. Cl.
*H01J 40/14* (2006.01)

(52) U.S. Cl. ..... 250/221; 340/545.3; 340/545.1

(58) Field of Classification Search ..... 250/221, 250/222.1; 340/540, 541, 550–567, 545.1, 340/545.3
See application file for complete search history.

(56) References Cited

U.S. PATENT DOCUMENTS

| | | | | |
|---|---|---|---|---|
| 3,346,856 A | | 10/1967 | Doble et al. | 340/939 |
| 3,670,164 A | * | 6/1972 | Hardy et al. | 250/366 |
| 3,989,932 A | | 11/1976 | Koerner | 340/938 |
| 4,075,563 A | | 2/1978 | Battle | 324/236 |
| 4,169,260 A | | 9/1979 | Bayer | 340/562 |
| 4,240,528 A | | 12/1980 | Kraus | 187/317 |
| 4,345,167 A | | 8/1982 | Calvin | 327/517 |
| 4,551,711 A | * | 11/1985 | Akiyama et al. | 340/567 |
| 4,565,029 A | | 1/1986 | Kornbrekke et al. | 49/25 |
| 4,612,442 A | | 9/1986 | Toshimichi | 250/353 |
| 4,652,864 A | | 3/1987 | Calvin | 340/553 |
| 4,706,227 A | | 11/1987 | DuVall et al. | 367/96 |
| RE32,828 E | | 1/1989 | Mudge | 250/342 |
| 4,849,635 A | | 7/1989 | Sugimoto | 250/340 |
| 4,849,735 A | | 7/1989 | Kirtley et al. | 340/539.1 |
| 4,853,531 A | | 8/1989 | Rejc | 250/221 |
| 4,857,912 A | | 8/1989 | Everett, Jr. et al. | 340/508 |
| 4,944,116 A | | 7/1990 | Mewald | 49/27 |
| 4,967,083 A | * | 10/1990 | Kornbrekke et al. | 250/341.7 |
| 5,001,557 A | * | 3/1991 | Begle | 348/166 |
| 5,026,990 A | | 6/1991 | Marman et al. | 250/342 |
| 5,027,552 A | | 7/1991 | Miller et al. | 49/27 |
| 5,034,722 A | | 7/1991 | Premack | 340/562 |
| 5,055,685 A | | 10/1991 | Sugimoto et al. | 250/342 |
| 5,142,152 A | | 8/1992 | Boiucaner | 250/341.3 |

(Continued)

FOREIGN PATENT DOCUMENTS

DE 3021363 A1 12/1981

(Continued)

OTHER PUBLICATIONS

SmartGate, Inc.; SmartGate: Non-contact Safety for Gates and Doors; (2002) 10 pages.

(Continued)

*Primary Examiner*—Thanh X. Luu
(74) *Attorney, Agent, or Firm*—Hanley, Flight & Zimmerman, LLC

(57) ABSTRACT

A detection system for detecting a body near a doorway includes two detectors having one or more activation lines that overlap each other. With certain mounting arrangements, the detectors cover areas within and on both sides of the doorway. The detectors are meant to help prevent an already open door from accidentally closing on the body. The door is powered by a drive unit that ignores the detectors when the door is closed.

5 Claims, 5 Drawing Sheets

U.S. PATENT DOCUMENTS

| | | | | |
|---|---|---|---|---|
| 5,142,822 | A | 9/1992 | Beckerman | 49/27 |
| 5,149,921 | A | 9/1992 | Picado | 187/317 |
| 5,198,974 | A | 3/1993 | Orsat | 700/56 |
| 5,216,246 | A | 6/1993 | Weldman et al. | 250/229 |
| 5,314,037 | A | 5/1994 | Shaw et al. | 180/169 |
| RE34,665 | E | 7/1994 | Strand | 250/221 |
| 5,334,972 | A | 8/1994 | Sugimoto et al. | 340/556 |
| 5,337,039 | A | 8/1994 | Simon | 340/562 |
| 5,357,183 | A | 10/1994 | Lin | 318/468 |
| 5,410,149 | A * | 4/1995 | Winston et al. | 250/221 |
| 5,420,430 | A | 5/1995 | Trett | 250/341.1 |
| 5,461,231 | A | 10/1995 | Sugimoto et al. | 250/342 |
| 5,468,960 | A | 11/1995 | Sugimoto et al. | 250/338.3 |
| 5,489,892 | A | 2/1996 | Imuro et al. | 340/567 |
| 5,541,585 | A * | 7/1996 | Duhame et al. | 340/5.62 |
| 5,584,145 | A | 12/1996 | Teich | 49/506 |
| 5,596,840 | A | 1/1997 | Teich | 49/26 |
| 5,656,995 | A * | 8/1997 | Peters | 340/541 |
| 5,689,235 | A | 11/1997 | Sugimoto et al. | 340/541 |
| 5,703,368 | A | 12/1997 | Tomooka et al. | 250/349 |
| 5,712,477 | A | 1/1998 | Delane, III et al. | 250/221 |
| 5,728,984 | A | 3/1998 | Miller | 200/61.43 |
| 5,739,523 | A | 4/1998 | Tsutsumi et al. | 250/221 |
| 5,743,317 | A | 4/1998 | Beringer et al. | 160/10 |
| 5,789,739 | A | 8/1998 | Schwarz | 250/221 |
| 5,793,357 | A | 8/1998 | Ivey et al. | 345/166 |
| 5,812,058 | A | 9/1998 | Sugimoto et al. | 340/556 |
| 5,828,302 | A | 10/1998 | Tsutsumi et al. | 340/540 |
| 5,921,026 | A | 7/1999 | Miller | 49/27 |
| 5,986,265 | A | 11/1999 | Kim et al. | 250/338.3 |
| 5,996,281 | A | 12/1999 | Takano et al. | 49/26 |
| 6,002,333 | A | 12/1999 | Hickey | 340/550 |
| 6,080,981 | A | 6/2000 | Payne | 250/221 |
| 6,218,940 | B1 * | 4/2001 | Rejc et al. | 250/221 |
| 6,243,006 | B1 * | 6/2001 | Rejc et al. | 340/436 |
| 6,286,257 | B1 | 9/2001 | Gregoriou et al. | 49/27 |
| 6,304,178 | B1 * | 10/2001 | Hayashida | 340/545.1 |
| 6,317,040 | B1 * | 11/2001 | Ikeda | 340/522 |
| 6,326,899 | B1 | 12/2001 | Chisnall | 340/686.1 |
| 6,342,706 | B1 | 1/2002 | Takeda | 250/559.4 |
| 6,348,685 | B1 | 2/2002 | Givet | 250/221 |
| 6,348,863 | B1 | 2/2002 | Krubiner et al. | 340/567 |
| 6,414,314 | B1 | 7/2002 | Ikeda | 250/353 |
| 6,427,382 | B1 | 8/2002 | Gregoriou et al. | 49/27 |
| 6,571,512 | B1 | 6/2003 | Miller et al. | 49/27 |
| 6,600,113 | B1 | 7/2003 | Miller | 200/61.43 |
| 6,651,385 | B1 | 11/2003 | Miller et al. | 49/27 |
| 6,678,999 | B1 | 1/2004 | Zengguang et al. | 49/25 |
| 6,683,296 | B1 | 1/2004 | Miller et al. | 250/221 |
| 6,730,902 | B1 | 5/2004 | Imai et al. | 250/221 |
| 6,750,441 | B1 | 6/2004 | Imahori et al. | 250/221 |
| 2002/0041231 | A1 | 4/2002 | Drinkard | 340/541 |
| 2002/0046494 | A1 | 4/2002 | Miller et al. | 49/26 |
| 2003/0047670 | A1 | 3/2003 | Miller et al. | 250/221 |
| 2004/0088922 | A1 | 5/2004 | Miller et al. | 49/26 |

FOREIGN PATENT DOCUMENTS

| | | |
|---|---|---|
| DE | 102 03 145 C1 | 4/2003 |
| EP | 0 236 755 B1 | 2/1992 |
| EP | 0 671 532 A1 | 4/1994 |
| EP | 0 699 619 A2 | 3/1996 |
| EP | 0 624 857 | 9/1998 |
| EP | 1 253 276 A2 | 10/2002 |
| EP | 0 902 158 B1 | 2/2003 |
| EP | 0 843 070 B1 | 3/2003 |
| EP | 0 902 157 B1 | 3/2003 |
| GB | 2 354 068 | 3/2001 |
| GB | 2 391 936 | 2/2004 |
| JP | 5-1991 | 1/1993 |
| JP | 2001-147276 | 5/2001 |
| JP | 2001-317270 | 11/2001 |
| JP | 2002-285755 | 10/2002 |
| JP | 2003-265639 | 9/2003 |
| WO | WO 02/19698 | 3/2002 |
| WO | WO 02/29747 | 4/2002 |
| WO | WO 02/29748 | 4/2002 |
| WO | WO 03/087513 | 10/2003 |

OTHER PUBLICATIONS

"Overhead Door JETROLL," Form A-988; (1995) 14 pages.

Optex, Inc.; Product Brochure for VX-40/40A Multi Stabilized Outdoor Detector; Received by applicant prior to Oct. 17, 2002; 4 pages.

* cited by examiner

PASSIVE DETECTION SYSTEM FOR DETECTING A BODY NEAR A DOOR

BACKGROUND OF THE INVENTION

1. Field of the Invention

The subject invention generally pertains to a system for detecting the presence of a body near a doorway and more specifically to a system that helps prevent a door from accidentally closing against the body.

2. Description of Related Art

There are a wide variety of available devices for detecting the presence of a body, such as a person or object, near a doorway. Such detection devices, known as photoelectric eyes, proximity sensors, motion detectors, operate under various principles including, ultrasonics; active and passive detection of infrared radiation; detection of electromagnetic radiation (including sensing radio waves or sensing changes in capacitance or inductance); and detecting a Doppler shift in microwaves; and lasers. In response to sensing a nearby body, the detector may simply trigger a light or an alarm, or the device may affect the operation of a door.

In door applications, a detection device generally falls under one of two categories: a door opener or a door interrupter. A door opener triggers the opening of a door for an approaching body, such as a shopper entering or leaving a store. A door interrupter, on the other hand, prevents an already open door from accidentally closing against a body that may be in the doorway or within the path of the door's travel.

Door openers typically monitor an area in front of the door where the approaching body is expected to travel. Since door openers are more for convenience than safety, the monitored area is a general vicinity rather than a tightly controlled, well defined area in front of the door. Often, the monitored area does not extend the full width of the doorway. So, in many cases, a body may avoid detection by approaching the door from the side, thereby reaching the door without the door being automatically opened. Such operation may be acceptable for a door opener, but a door interrupter preferably provides more complete coverage to minimize the possibility of an approaching body avoiding detection.

Some door interrupters comprise an antenna that creates an electromagnetic field along the leading edge of a vertically operating door. When a nearby body disturbs the field by coming within a few inches of it, the door interrupter may respond by stopping or reversing the closing action of the door. Since the antenna, and thus its field, moves up and down with the leading edge of the door, somebody may be tempted to "beat the door" by racing underneath a closing door before the interrupter can sense their presence.

Some reliable door interrupters have a horizontal activation line that is about 24-inches above the floor and extends completely across the width of the doorway. So, anything taller than the height of the activation line would have to trigger the door interrupter upon passing through the doorway. Since activation lines of such door interrupters typically lie immediately adjacent to the door, an approaching body typically will not trigger the interrupter unless the body is within or right next to the doorway.

Consequently, there is a need for a door interrupter whose field of view is broader than current door interrupters and more complete and well defined than current door openers.

SUMMARY OF THE INVENTION

In some embodiments, a detection system for detecting a body near a doorway includes a remote body detector disposed below a lintel of the doorway, wherein the detector may have a plurality of activation lines including an activation line that passes completely through the doorway or through the door's path of travel.

In some embodiments, a detection system for detecting a body near a doorway includes a remote body detector having at least one activation line that points away from the door's path of travel, wherein the detector is unresponsive when the door is substantially closed.

In some embodiments, a detection system for detecting a body near a doorway includes a remote body detector disposed below a lintel of the doorway and having at least one activation line that points away from the door's path of travel, wherein the detector causes the door to stop or open in response to the activation line being disturbed.

In some embodiments, a detection system for detecting a body near a doorway includes two remote body detectors disposed below a lintel of the doorway, wherein the detectors create two detection areas that overlap each other with at least one of the two detection areas extending through the door's path of travel.

In some embodiments, a detection system for detecting a body near a doorway includes two remote body detectors disposed below a lintel of the doorway and providing overlapping (as viewed from above and looking down) activation lines that cross in front of the doorway.

In some embodiments, a detection system for detecting a body near a doorway includes two remote body detectors disposed below a lintel of the doorway, wherein each detector has an upper and lower set of activation lines.

In some embodiments, a detection system for detecting a body near a doorway includes two remote body detectors disposed above a lintel of the doorway, wherein the detectors create overlapping areas of activation.

In some embodiments, a detection system for detecting a body near a doorway includes at least one remote body detector that defines an activation area that extends completely across the width of a doorway and extends out in front of the doorway.

DESCRIPTION OF THE PREFERRED EMBODIMENT

Figure 1:
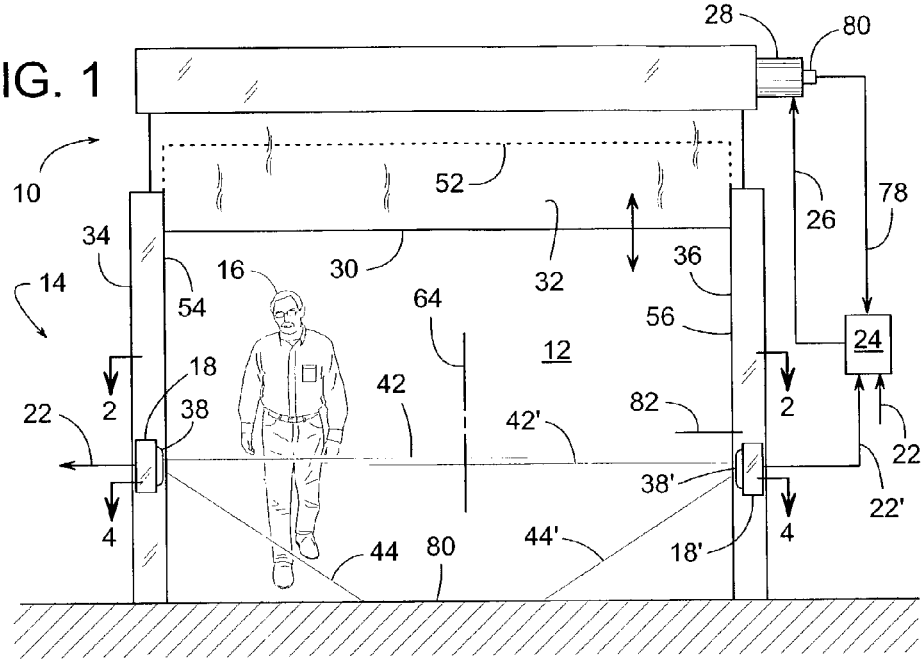
FIG. 1 is a front view of a door with a detection system for detecting a nearby body but without a housing of the detector shown.

Referring to FIGS. 1 and 2*a–c*, a door 10 at a doorway 12 is provided with a detection system 14 that helps prevent door 10 from accidentally closing on a nearby body 16, such as a person or object. The term, "doorway" refers to an opening in a wall, and may be defined by a lintel 52, a left lateral edge 54 and a right lateral edge 56. It will be appreciated that a door is typically installed immediately adjacent such a doorway and thus that the structure of the door (sideframes, tracks, header structure, etc.) may be substantially co-extensive with the doorway itself, and thus considered an extension thereof. System 14 comprises at least one remote body detector 18 and 18' with at least one activation line 20. In response to body 16 crossing, obstructing, interrupting or otherwise disturbing line 20 while door 10 is not completely closed, detector 18 provides a signal 22. Signal 22 can be used as an input to a controller 24 that responds to the input by providing an output 26 to a drive unit 28. Drive unit 28 normally powers door 10 open and closed in a conventional manner but inhibits door 10 in response to output 26.

In the case where door 10 represents a vertically operating door, drive unit 28 can open or close door 10 by raising and lowering the door's leading edge 30. Examples of a vertically operating door include, but are not limited to, sectional doors and rollup doors. Sectional doors have pivotally interconnected, track-guided door panels that cover a doorway when closed and store overhead or above the opening when open. Rollup doors typically have a curtain wrapped about a drum that a drive unit can rotate in either direction to raise or lower the curtain in front of the doorway. Various embodiments of the invention will be described with reference to door 10 being a vertically operating door with a curtain 32 whose movement is guided within two tracks 34 and 36. It should be appreciated, however, that sectional doors, swinging doors, horizontally sliding doors, and many other types of doors and drive units are well known to those skilled in the art and may be within the scope of the invention.

Detector 18 is schematically illustrated to represent any remote body detector that may operate under various principles to create activation line 20. The term, "activation line" refers to any line in space that when sufficiently disturbed creates a response in a detector associated with the line. The term, "disturbed" refers to changing some aspect of an established activation line. Examples of disturbing an activation line include, but are not limited to, obstructing, reflecting, absorbing, radiating, illuminating, and interfering. Examples of operating principles under which detector 18 may operate include, but are not limited to, ultrasonics; active and passive detection of infrared radiation; detection of electromagnetic radiation (including sensing radio waves or sensing changes in capacitance or inductance); and detecting a Doppler shift in microwaves; and lasers.

Further description of detector 18 will be with reference to a currently preferred embodiment, wherein detector 18 is a passive infrared device, such as a VX-402 provided by Optex Incorporated, of Torrance, Calif. Passive infrared means that detector 18 senses infrared radiation that radiates from body 16. In other words, the VX-402 functions by way of passive detection of infrared radiation, which is one example of the previously listed operating principles under which detector 18 may operate The passive infrared detection of the VX-402 thus corresponds to an activation line being "disturbed" as defined above. In comparison, active infrared radiation originates from within the detector and reflects off body 16 to return to the detector for sensing. For the passive infrared according to this embodiment, each detector 18 may include a fresnel lens 38 with distinct areas within the lens for segregating the detector's field of view into a plurality of activation lines (sometimes referred to as fingers). Each distinct area of lens 38 focuses its respective activation line or finger onto at least one pyro-electric sensor 40 that senses infrared radiation (see FIG. 4).

In some cases, lens 38 further segregates the incoming infrared radiation into an upper set of activation lines 42 (including line 20) and a lower set of activation lines 44. Lens 38 focuses the upper set of activation lines 42 onto one of the pyro-electric sensors 40 and focuses the lower set of activation lines 44 onto another sensor 40. The two sets of lines 42 and 44 can define two pie-shaped areas of sight 46 and 48, respectively. Simultaneous actuation of upper and lower sets of lines 42 and 44 can be used to avoid certain nuisance-triggering situations as explained in U.S. Pat. No. 5,703,368.

Portions of lens 38 can be masked to block out selected activation lines. For example, all but activation line 20 may be blocked, or just the inner lines may be blocked to leave just line 20 and an opposite line 50 visible to detector 18. Further information about remote body detectors, such as detector 18, can be found in U.S. Pat. Nos. 5,703,368 4,612,442; and 5,986,265, which are specifically incorporated by reference herein.

In a currently preferred installation, detection system 14 includes two detectors mounted below lintel 52 of doorway 12. Detector 18 is at the lower end of left lateral edge 54 of doorway 12, and a similar detector 18', with a similar lens 38' and similar sets of upper and lower activation lines 42' and 44', is at the lower end of right lateral edge 56. Such an arrangement is particularly useful in applications where an activation line extends through the path of travel of a vertically operating door. Because, for instance, as door 10 closes, leading edge 30 does not prematurely block activation lines that may extend through the door's path of travel. The term, "path of travel" can be defined as an area in space swept out by the door's leading edge (e.g., edge 30) as the door opens or closes. The swept area is generally, but not necessarily, planar.

Figure 2A:
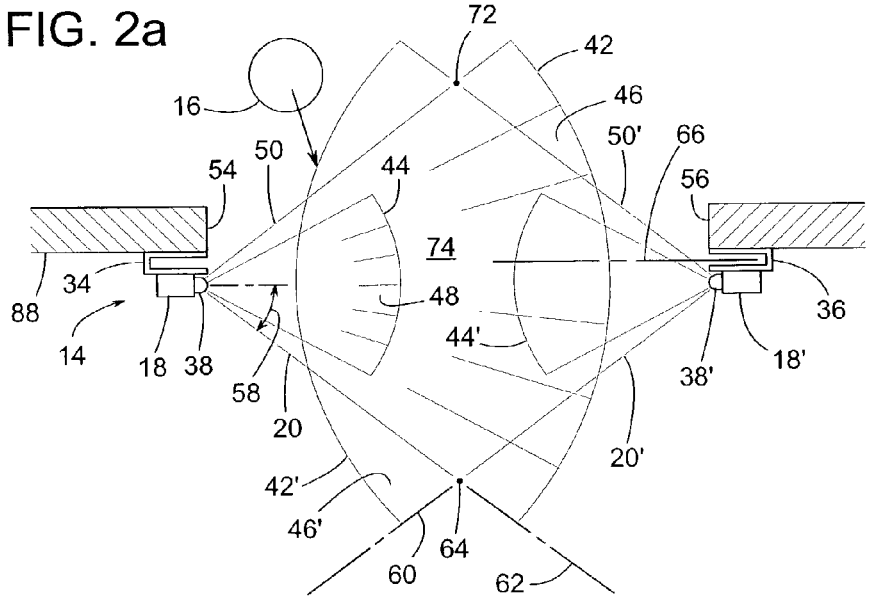
FIG. 2*a* is a cross-sectional top view taken along line 2—2 of FIG. 1 but without a housing of the detector shown.
Figure 2B:
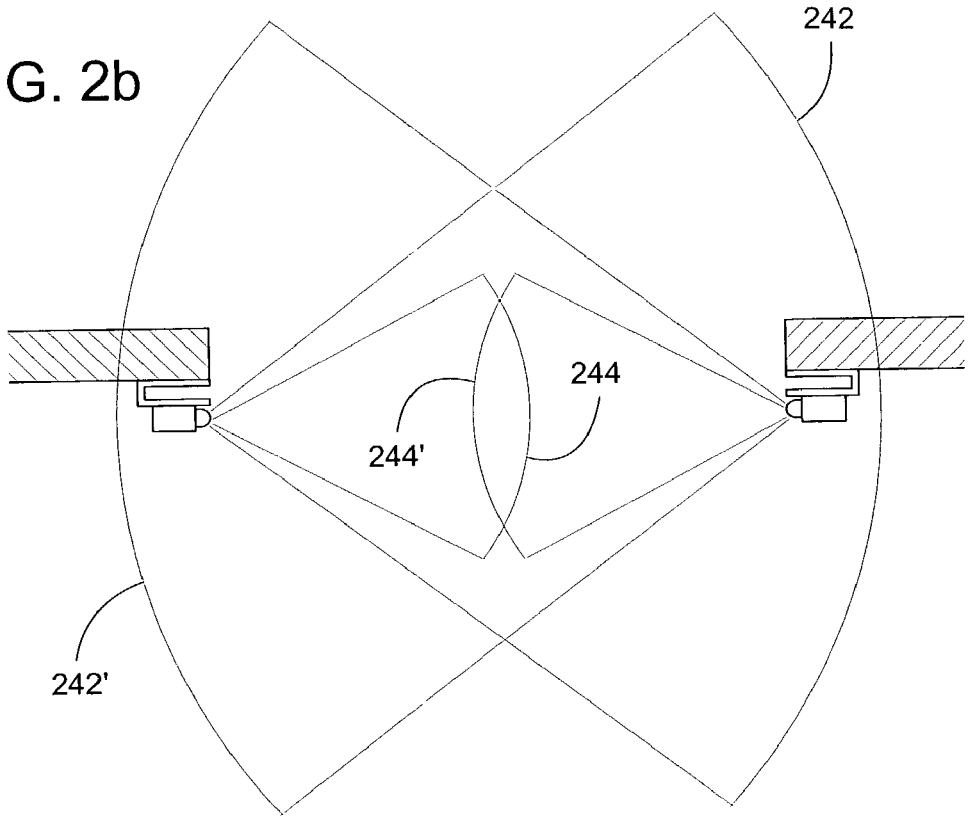
FIG. 2*b* is similar to FIG. 2*a* but showing a different pattern of activation lines.
Figure 2C:
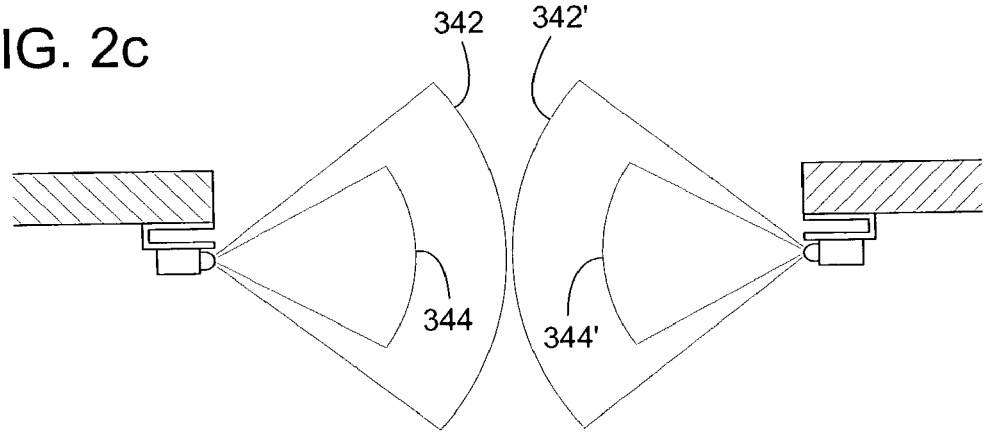
FIG. 2*c* is similar to FIG. 2*a* but showing yet another pattern of activation lines.

The pie shape of each set of activation lines 42, 42', 44 and 44' can be of various sizes and layouts, as shown in FIGS. 2*a–c*. Numerals 42, 42', 44 and 44' of FIG. 2*a* correspond respectively to numerals 242, 242', 244 and 244' of FIG. 2*b*, and they also correspond respectively to numbers 342, 342', 344 and 344' of FIG. 2*c*. In FIG. 2*b*, activation lines 242 and 242' extend completely through door's path of travel 66, and activation lines 244 and 244' overlap each other. In FIG. 2*c*, activation lines 342 and 342' do not overlap, but they are sufficiently close to prevent intrusion, meaning that an average sized human would not be able to pass through the gap.

In some embodiments, detectors 18 and 18' each have only a single activation line that points at an angle 58 away from door's path of travel 66. An activation line 20' of detector 18' lies in a first vertical plane 60, and line 20 of detector 18 lies in a second vertical plane 62, with planes 60 and 62 intersecting at a vertical line 64 that is offset relative to the door's path of travel 66. So, lines 20 and 20' may overlap each other in front of the doorway (i.e., one activation line overlays the other when viewed from above and looking downward even though they may not actually occupy the same geometric space as one may be disposed underneath the other, yet still "overlay" it when viewed from above in a plan perspective). Lines 20 or 20' extending out in front of doorway 12 enables detector 18 or 18' to detect an approaching body before the body actually reaches the doorway.

To detect body 16 approaching the door from the direction illustrated by body 16, detectors 18 and 18' may include activation lines 50 and 50', respectively. Lines 50 and 50' pass completely through the door's path of travel 66 to overlap at a vertical line 72 that is offset to path of travel 66 in a direction toward body 16.

For greater security, detector 18 may have the full set of activation lines 42 between lines 20 and 50 to create activation area 46, and detector 18' may have a full set of activation lines 42' between lines 20' and 50' to create a similar activation area 46'. Activation areas 46 and 46' preferably create an overlapping area 74 with at least one area 46, 46' and/or 74 extending into the door's path of travel 66. Again, this overlapping area is actually an overlay of the two activation areas when viewed from a plan perspective, as they may not physically overlap. Also, one or more activation lines of lower set 44, and one or more activation lines of lower set 44' of detector 18' can be employed by unmasking appropriate areas of lens 38 and 38'.

To interrupt the closing of door 10 in response to input 22 from detector 18 and/or a similar input 22' from detector 18', controller 24 may operate under various control schemes. For instance, output 26 from controller 24 may stop or raise door 10 in response to signal 22 or 22' indicating that an activation line, e.g., line 20 or 20', has been disturbed. Or, controller 24 may be such that it stops or raises door 10 in response to a disturbance of a combination of activation lines, such as lines 20 and 20', lines 50 and 50', lines 42 and 44, etc. Such control is readily achieved by controller 24, which is schematically illustrated to represent any device that can control door 10 in response to one or more signals from detector 18 or 18'. Examples of controller 24 include, but are not limited to, a PLC (programmable logic controller), computer, relay circuit, digital circuitry, analog circuitry and various combinations thereof.

In some cases, controller 24 may receive a door position signal 78 from a rotary limit switch 80, which is coupled to a drum that raises and lowers curtain 32. Signal 78 may indicate one or more positions of door 10, such as a closed position (leading edge 30 being adjacent to a floor 80), a fully open position (leading edge 30 adjacent to or above lintel 52), and an intermediate position 82 (leading edge 30 just above an activation line of detector 18 or 18'). Signal 78 can not only be used to stop drive unit 28 when door 10 is fully open or closed but can also determine whether drive unit 28 responds to an activation line being disturbed. For instance, to avoid having detection system 14 falsely identify a body entering doorway 12 when actually the door itself disturbed an activation line, controller 24 may disregard inputs 22 and 22' when signal 78 indicates that door 10 is below intermediate position 82.

When door 10 is installed in front of doorway 12, as shown, rather than being directly inside doorway 12, then detectors 18 and 18' are preferably installed in front of the doorway as well. This helps in centering activation areas 46 and 46' more closely underneath leading edge 30 of door 10. In some cases, tracks 34 and 36 provide a convenient place for mounting detectors 18 and 18'. However, mounting detectors 18 and 18' so that activation lines aim in front of and behind doorway 12 can still be challenging. To provide line activation on both sides of the door's path of travel 66, lenses 38 and 38' may need to face each other. Unfortunately, certain styles of detector 18 appear to be designed with a lens meant for facing away from the detector's mounting surface.

Figure 3:
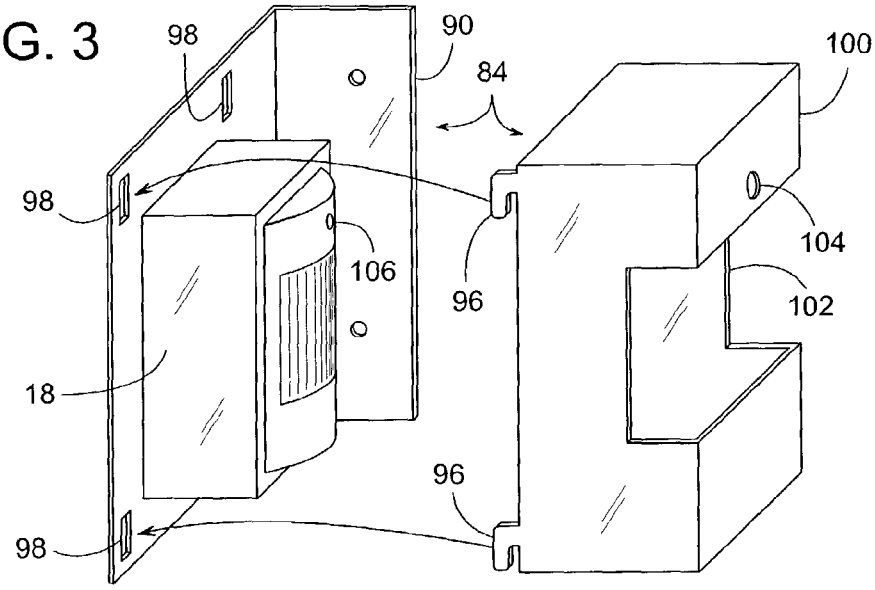
FIG. 3 is an exploded perspective view showing a housing being assembled over a remote body detector.
Figure 4:
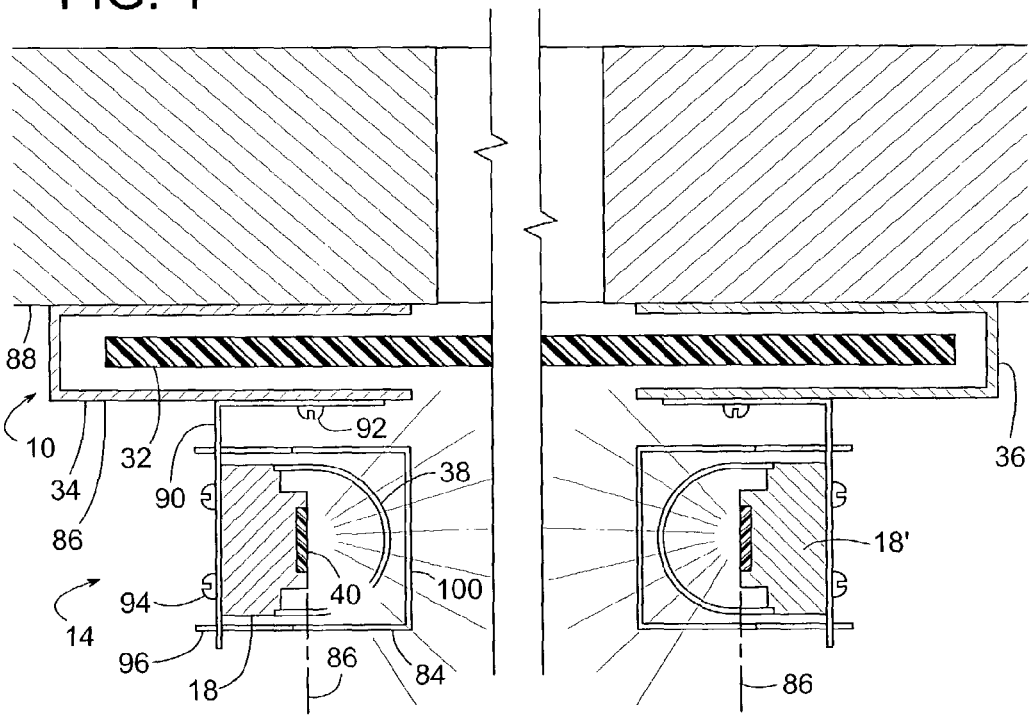
FIG. 4 is a cross-sectional top view taken along line 4—4 of FIG. 1 with each detector shown mounted within a housing and with the curtain of the door lowered to a level below the detectors.

To mount detectors 18 and 18' so that their lenses 38 and 38' generally face each other and to protect the detectors from impact, a housing 84 helps to install detectors 18 and 18' in a sideways orientation, as shown in FIGS. 3 and 4. This orientation angularly displaces a face 86 of sensors 18 and 18' out of parallel alignment with each other and out of parallel alignment with a mounting surface 86 or a wall 88, thereby providing activation lines on both sides of doorway 12. In some cases, housing 84 comprises an angle bracket 90 that a fastener 92 connects to a mounting surface, such as track 34. Another fastener 94 connects detector 18 to bracket 90. Tabs 96 and holes 98 removably attach a cover 100 to bracket 90. One cutout 102 in cover 100 is for exposing lens 38, and another cutout 104 is for viewing an indicator light 106.

Figure 5:
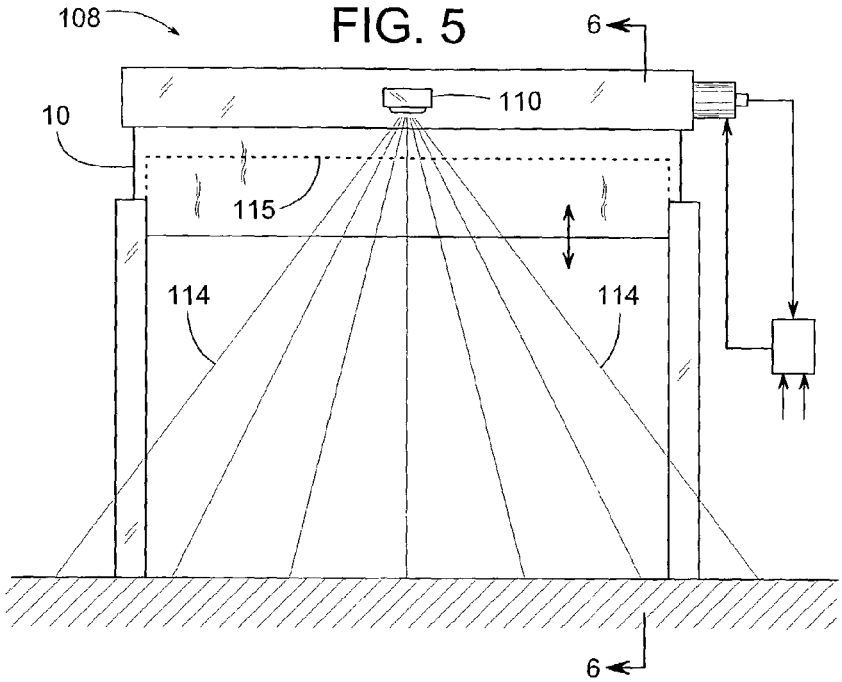
FIG. 5 is a front view of door with another detection system.
Figure 6:
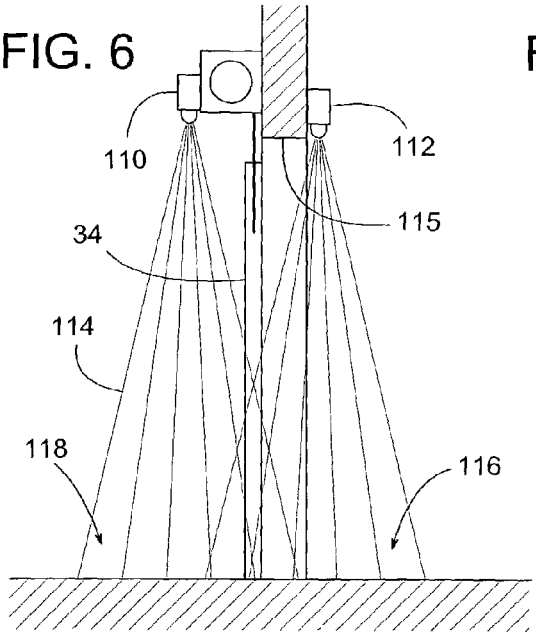
FIG. 6 is a cross-sectional side view taken along line 6—6 of FIG. 5.

In another embodiment, shown in FIGS. 5 and 6, a detection system 108 includes two active infrared detectors 110 and 112 that are installed above lintel 115 and point downward. In this example, detectors 110 and 112 each emits infrared radiation that body 16 can reflect back into the detector. Detectors 110 and 112 can detect the presence of body 16 by comparing the reflected radiation to the emitted radiation. The infrared radiation preferably travels along several activation lines 114 that diverge from detectors 110 and 112 to create one activation area 116 in front of door 10 and another activation area 118 behind door 10. Areas 116 and 118 may overlap each other (when viewed from a plan perspective) to create an overlapping area, such that at least area 116, 118, or the overlapping area extends into the doorway.

Figure 7:
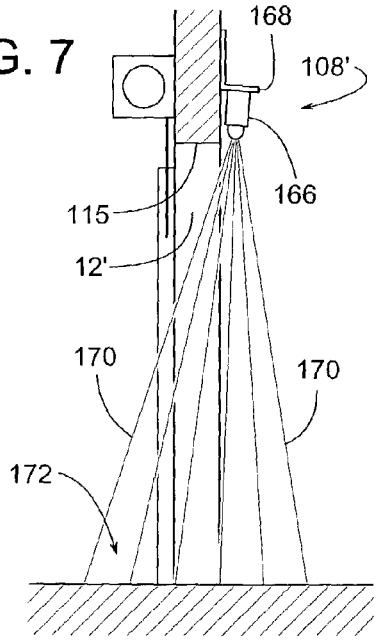
FIG. 7 is similar to FIG. 6 but with detection system having just one overhead detector.

In a similar embodiment, shown in FIG. 7, a detection system 108' has just one detector 166 (similar to detector 18 or 110). A mounting bracket 168 points detector 166 at a slight angle downward so that activation lines 170 extend through a doorway 12'. This enables detector 166 to monitor an area 172 on both sides of doorway 12'.

Figure 8:
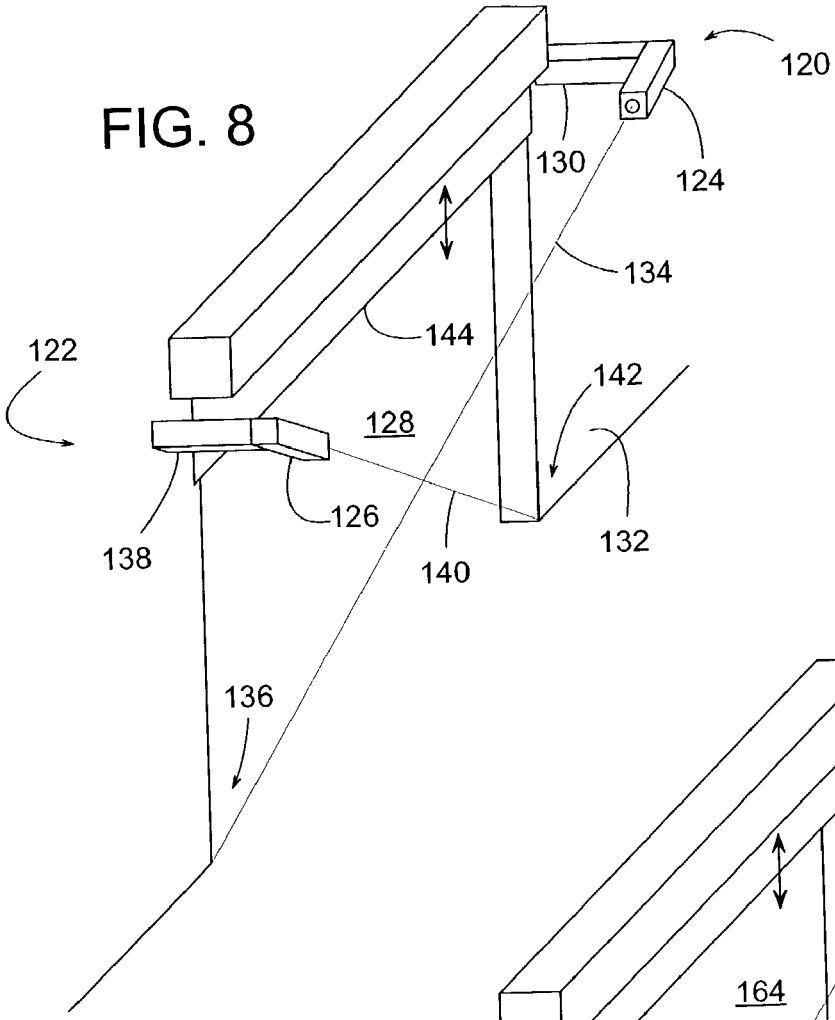
FIG. 8 is a perspective view of doorway with another detection system.

In another embodiment, shown in FIG. 8, a detection system 120 comprises a remote body detection arrangement 122 where two remote body detectors 124 and 126 have activation lines that cross (but not necessarily intersect) in front of a doorway 128. The term, "remote body detection arrangement" refers to at least one detector with one or more additional detector-related components, such as a mirror or a second detector. A bracket 130 holds detector 124 away from the face of a wall 132, and detector 124 aims an activation line 134 to a lower left corner 136 of doorway 128. Likewise, bracket 138 holds detector 126 away from the face of wall 132, and detector 126 aims an activation line 140 to a lower right corner 142 of doorway 128. Signals from detectors 124 and 126 can be used to inhibit a door 144 from accidentally closing on body 16.

Figure 9:
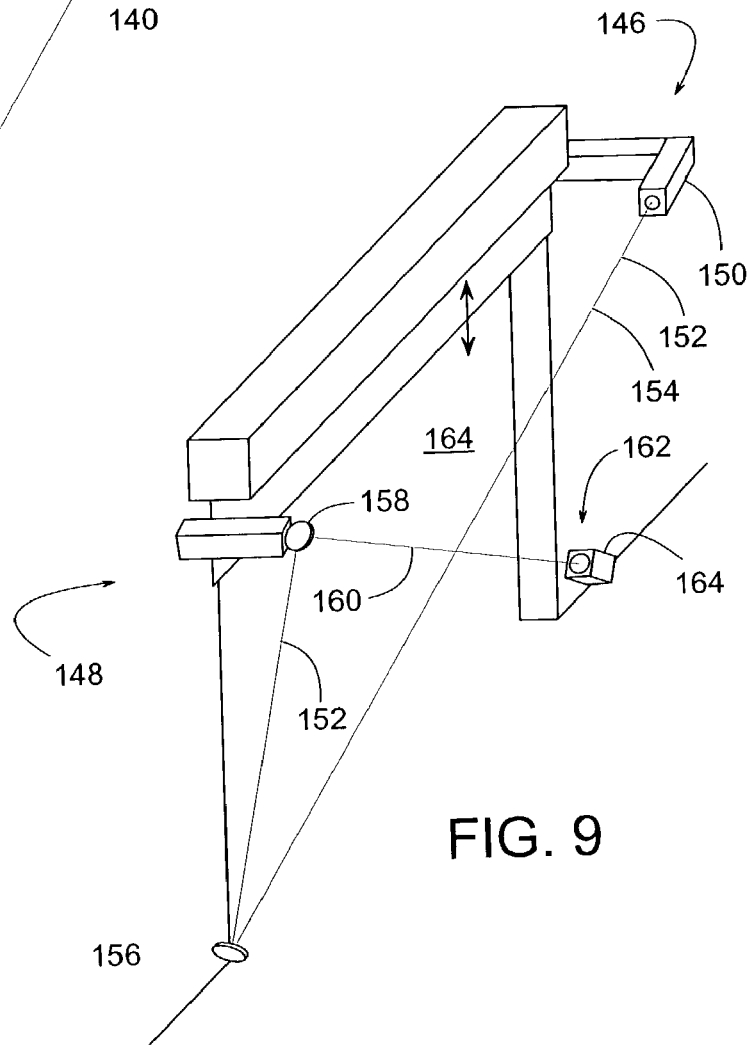
FIG. 9 is a perspective view of doorway with another detection system.

A detection system 146 of FIG. 9 is similar to that of FIG. 8 except mirrors eliminate the need for detector 126. Detection system 146 has a remote body detector arrangement 148 with a detector 150 having an activation line 152 that has one line segment 154 extending between detector 150 and a mirror 156, which reflects line 152 up to another mirror 158. Mirror 158 then reflects another segment 160 of activation line 152 toward a lower right corner 162 of a doorway 164. Depending on the principle under which detector 150 operates, corner 162 may or may not have a detection device 164 that is associated with detector 150. Device 164 is schematically illustrated to represent any detector-related apparatus, such as a mirror, infrared receiver, laser receiver, photo eye, etc. Device 164 may be omitted if detector 150 is a passive infrared detector.

Although the invention is described with respect to a preferred embodiment, modifications thereto will be apparent to those skilled in the art. Therefore, the scope of the invention is to be determined by reference to the claims, which follow.

We claim:

1. A detection system for detecting a body near a door, the door having a path of vertical travel that is adjacent to a doorway defined by a lintel, a right lateral edge and a left lateral edge, the detection system comprising:

a first stationary and passive remote body detector adjacent to the right lateral edge of the doorway and having a first activation area; and a second stationary and passive remote body detector adjacent to left lateral edge of the doorway and having a second activation area wherein at least one of the first activation area and the second activation area extends through the path of vertical travel when the door is open, and wherein the first and second activation areas overlap to define an overlapping activation area.

2. The detection system of claim 1, wherein the first activation area extends completely through the path of vertical travel.

3. The detection system of claim 1, wherein the first passive remote body detector also has a lower activation area that extends below the first activation area.

4. The detection system of claim 1, further comprising a drive unit coupled to the door and selectively responsive to at least one of the first and second passive remote body detectors, such that the drive unit interrupts the door when at least one of the first and second activation areas is disturbed and the door is above a predetermined intermediate position, and the drive unit is unresponsive to the first passive remote body detector when the door is below a predetermined intermediate position.

5. The detection system of claim 1, wherein the overlapping activation area extends into the path of vertical travel.

* * * * *